United States Patent [19]

Kober

[11] 4,093,205

[45] June 6, 1978

[54] FRENCH FOLDER CONSTRUCTION

[75] Inventor: Kasimir Kober, Chicago, Ill.

[73] Assignee: Chicago Dryer Company, Chicago, Ill.

[21] Appl. No.: 728,080

[22] Filed: Sep. 30, 1976

[51] Int. Cl.[2] ..... B65H 45/22

[52] U.S. Cl. ..... 270/66; 270/86

[58] Field of Search ..... 270/66, 62, 86

[56] References Cited

U.S. PATENT DOCUMENTS

| | | | |
|---|---|---|---|
| 2,887,313 | 5/1959 | Malott | 270/66 |
| 3,204,353 | 9/1965 | Hajos | 270/66 |
| 3,396,878 | 8/1968 | Snayberger | 270/66 |
| 3,462,138 | 8/1969 | Grantham | 270/62 |
| 3,829,081 | 8/1974 | Gerstenberger | 270/86 |
| 3,980,290 | 9/1976 | Sjoman | 270/86 |

*Primary Examiner*—Edgar S. Burr

*Assistant Examiner*—A. Heinz

*Attorney, Agent, or Firm*—Neuman, Williams, Anderson & Olson

[57] ABSTRACT

An apparatus is adapted to fold a foldable article, such as a towel or the like, into three panels of substantially equal width, with the side panels overlapped beneath a central panel in the course of effecting a French fold. Such apparatus includes a feed conveyor having an adjustable support for the article central panel, and an adjustable underlying folding plate adapted to precisely position the intermediate article panel whereby a French fold is effected in which all three panels are desirably of substantially equal width. The adjustable central panel support and adjustable plate means are simultaneously adjusted and interrelated to automatically effect desired folds in the normal course of apparatus use.

6 Claims, 13 Drawing Figures

FIG. 5
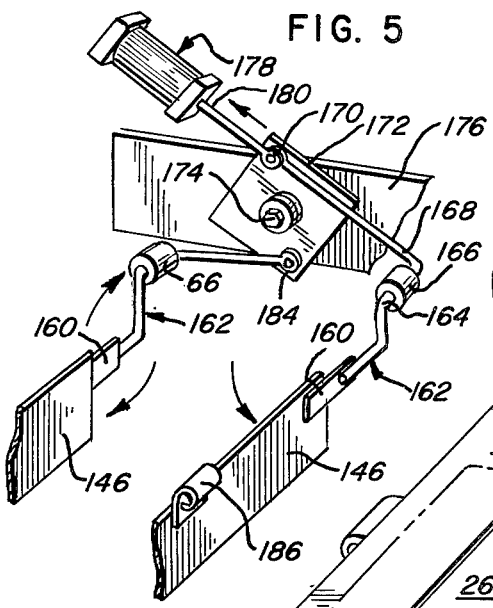
FIG. 6
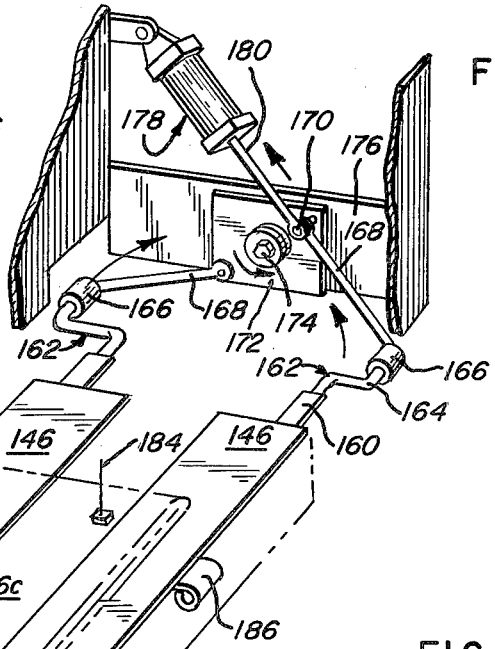
FIG. 8
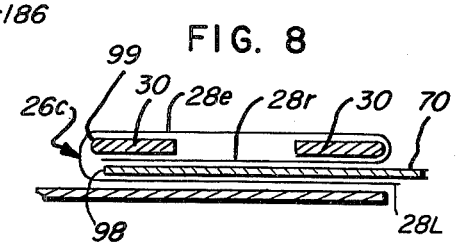
FIG. 9
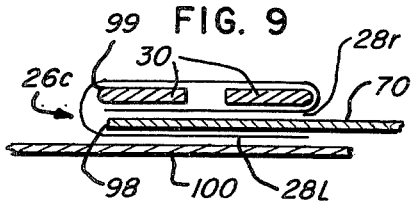
FIG. 7
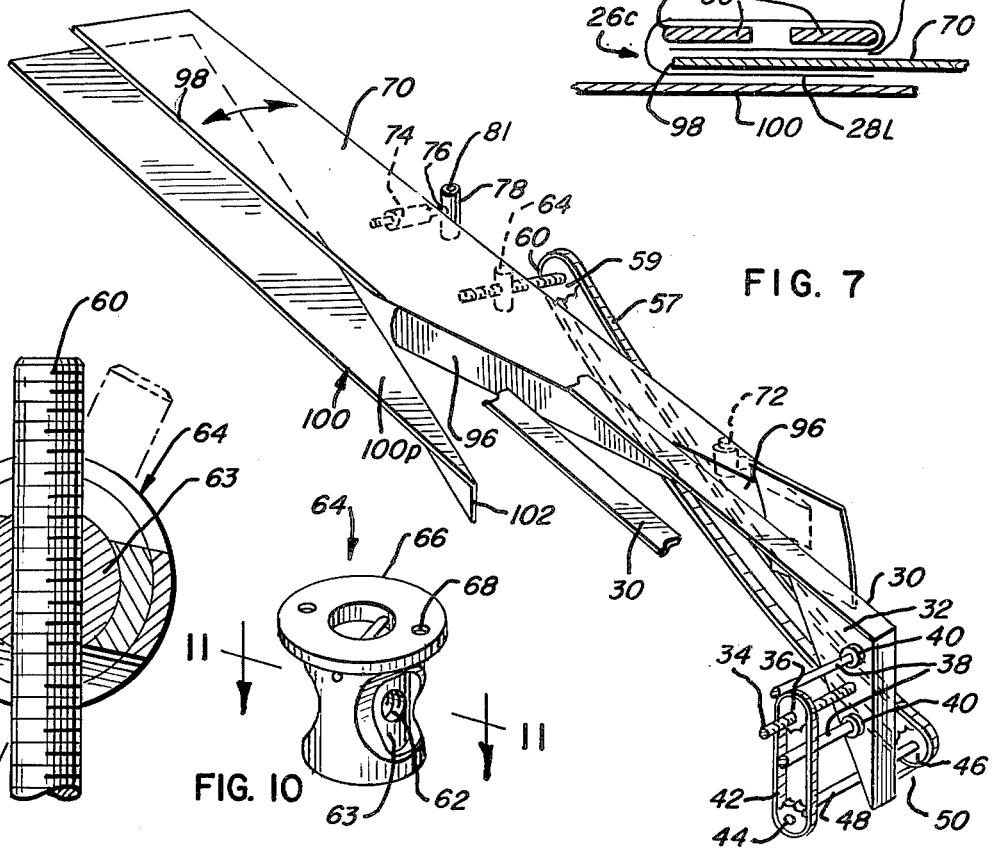
FIG. 11
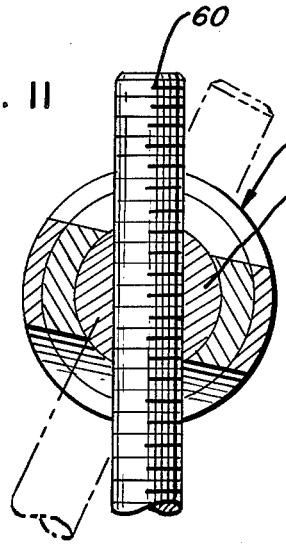
FIG. 10

FRENCH FOLDER CONSTRUCTION

This invention relates to an apparatus for folding foldable articles such as textile articles, and more particularly pertains to the formation of French folds in laundry items such as towels or the like.

The "French fold" is well-known and employed in many institutions such as hotels, motels and the like where a central panel which may bear a monogram or the like is outwardly displayed on a hanger or rack in overlying relation with underlying side panels.

French folds present a neat, attractive appearance and are often formed by hand in the home by the housewife in hanging bath or face towels on racks in the bathroom.

Because of the difficulty in forming such a fold by machine, apparatus of the prior art is often cumbersome or operable with difficulty if neat appearing French folds divided into three panels of desirably equal width are to be formed.

Thus Grantham U.S. Pat. No. 3,452,979 is directed to a laundry folder adapted to form a plurality of folds including a French fold and incorporates therein staggered spaced support plates under which are located folding plates. Gerstenberger U.S. Pat. No. 3,829,081 is directed to a small piece folder in which a French fold is effected by folding members disposed on opposed sides of a conveyor in which side panels of a foldable article are folded on top of such article as it is conveyed. In neither of these patents is there disclosed the novel interrelation of conveyor and underlying folding plates as will be hereinafter disclosed in detail.

It is an object of this invention, therefore to provide apparatus adapted to form a French fold in a foldable article and which assures desired precise formation of the article panels by means of a novel interrelation between the conveyor and underlying folding plates.

It is another object of this invention to provide an apparatus particularly designed to fold foldable textile articles which is extremely compact in design and simple in details of construction whereby maintenance and repair is greatly facilitated.

It is a further object of this invention to provide apparatus adapted to efficiently form a French fold in small pieces such as towels, napkins and the like which vary in peripheral dimensions by the simple setting of appropriate switch members.

It is still a further object of this invention to provide a novel conveyor and folding plate arrangement whereby a single control automatically adjusts the relationship between such conveyor and a folding plate assuring proper disposition of side panel members beneath a central panel of a foldable object in which a French fold is formed.

The above and other objects of this invention will become more apparent from the following detailed description when read in the light of the accompanying drawing and appended claims.

In one embodiment of a folding apparatus made in accordance with this invention, overlying feed tapes grip a foldable article in which a French fold is to be formed and slidably move the same from a feedplate onto adjacent spaced conveyor runners on which a central longitudinal panel portion of the foldable article is supported. Opposed longitudinal side panels depend by gravity from the central panel on the spaced runners during movement.

Prior to feeding the foldable article onto the spaced runners, an adjustment is made by the machine operator automatically setting the interval between the runners so as to define a central panel in the object to be folded which is approximately one-third the width of such article. Accordingly, when conveyed over the spaced runners by the conveyor ribbons, opposed side panel portions of the foldable article of approximately one-third of the article width depend from the outer runner edges.

In the course of being longitudinally moved over the runners, the depending panels are urged into overlapping relationship beneath the central panel as the article is slidably driven along the runners by means of the overlying conveying tapes.

The longitudinally folded article is driven from the end of the spaced runners of the upper conveyor onto an underlying conveyor moving toward the feed end of the apparatus. At the distal end of such second underlying conveyr, counter-rotating rolls drive the leading edge of the French folded sheet downwardly over a concave plate into engagement with a switch actuator. A folding blade then drives the mid-point of the French folded sheet between counter-rotating pinch rolls and onto spaced runners comprising opposed portions of a trap door over which driving feed tapes engage the now cross-folded foldable article as they longitudinally drive such foldable article in an axial direction toward the rear of the folding apparatus.

Upon reaching a predetermined point on the trap door runners, a switch actuator is engaged which instantaneously stops the third conveyor tapes and downwardly opens the opposed supporting runners defining the trap door whereby the folded article drops in substantially the vertical plane in the absence of twisting.

Thus, successive articles processed by the folding apparatus dropping from such trap door may form a neat vertical stack. A counting mechanism may be employed in conjunction with the conveyor on which the stacked articles are formed so as to move a stack of predetermined number after the same has been formed to a location spaced from the overlying discharge trap doors. An attendant disposed to the rear of a plurality of such folders may then stack the folded articles in a basket or the like.

In a modified arrangement, the conveyors receiving the folded articles discharged from the folding apparatus may return the folded articles to a location adjacent the front of the machine whereat the attendant feeding such machine may place the same in a basket or the like.

The attendant feeding the folding apparatus of this invention, prior to feeding a foldable article into the apparatus will set two switches. One switch will adjust the width between the supporting runners of the uppermost feed conveyor, and simultaneously adjust the angular disposition of the uppermost fold plate which effects folding of a first side panel beneath the central panel of a foldable article driven along the spaced runners of the uppermost conveyor. Thus a neat, precise French folded article is formed without the danger of bulging or improper folding under of the side panels. Although the main feed conveyor runners and the underlying fold plate are predeterminately spaced by means of a first switch, the operator also adjusts prior to apparatus operation, the switch actuating the blade means effecting the cross-fold in accordance with the length of the object being folded.

For a more complete understanding of this invention reference will now be made to the drawings wherein:

FIG. 5 is a fragmentary perspective view illustrating a pneumatic cylinder and associated components employed for purposes of rotating spaced, foldable article supports defining a trap door into article discharge and article supporting positions, FIG. 5 illustrating the article supports in the discharge position;

FIG. 6 is a fragmentary perspective view similar to FIG. 5 illustrating the pneumatic cylinder with its piston rod in the extended position whereby the spaced article supports defining a trap door are returned to their article support position, a supported article being illustrated thereon in a folded condition in phantom lines;

Figure 12:
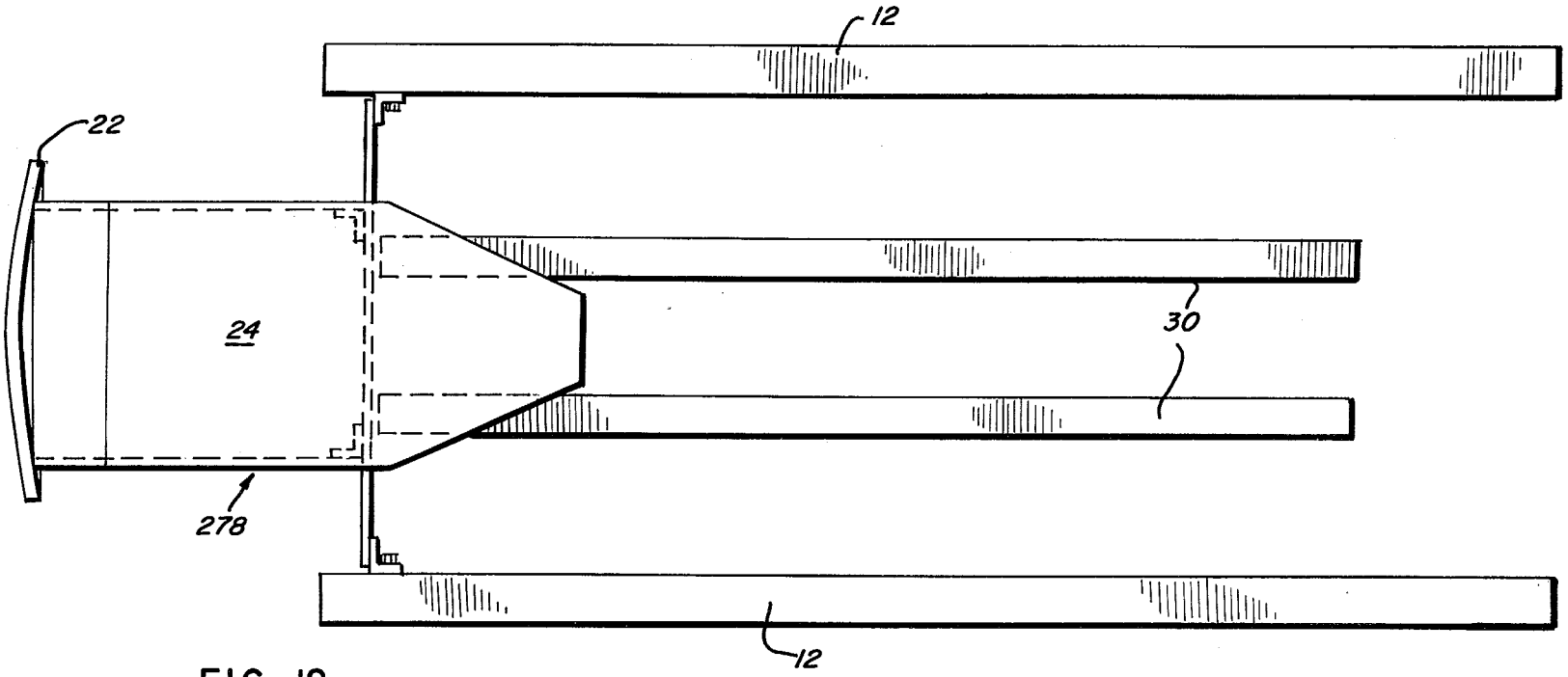
Figure 13:
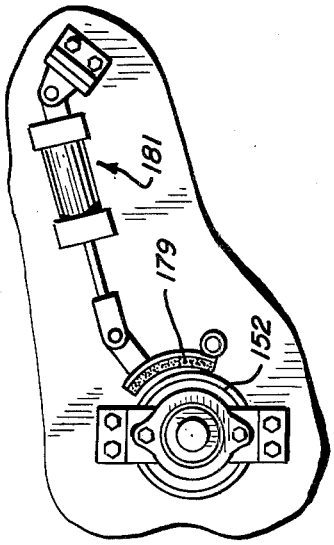

FIG. 7 is a perspective view illustrating the fold plate members and associated components employed in conjunction with spaced runner members fragmentarily illustrated and adapted to support the central panel of a foldable article for purposes of forming a French fold wherein such central panel of a foldable article has folded therebeneath opposed side panels of approximately one-third the width of such foldable articles;

FIG. 8 is a sectional view illustrating article support runners defining a feed conveyor portion of the illustrated apparatus in cooperative relationship with underlying folding plate members, with a foldable article folded about such components in a French fold;

FIG. 9 is a view similar to FIG. 8 illustrating the article supporting runner members and underlying folding plates in a relationship to form a French fold in a foldable article of lesser width than the article illustrated in FIG. 8;

FIG. 10 is a perspective view of a traveling pivot employed for purposes of supporting the upper folding plate illustrated in FIG. 7;

FIG. 11 is a sectional view taken on line 11—11 of FIG. 10 in illustrating a supporting threaded rod in engagement with the pivot of FIG. 10;

FIG. 12 is a top plan view of the unitarily formed spreader, feed plate and feed conveyor runners of the provided apparatus pivotally mounted to the opposed apparatus side frames; and FIG. 13 is an enlarged elevational view illustrating a braking mechanism employed in conjunction with the drive roller for the apparatus lowermost discharge conveyor.

Figure 1:
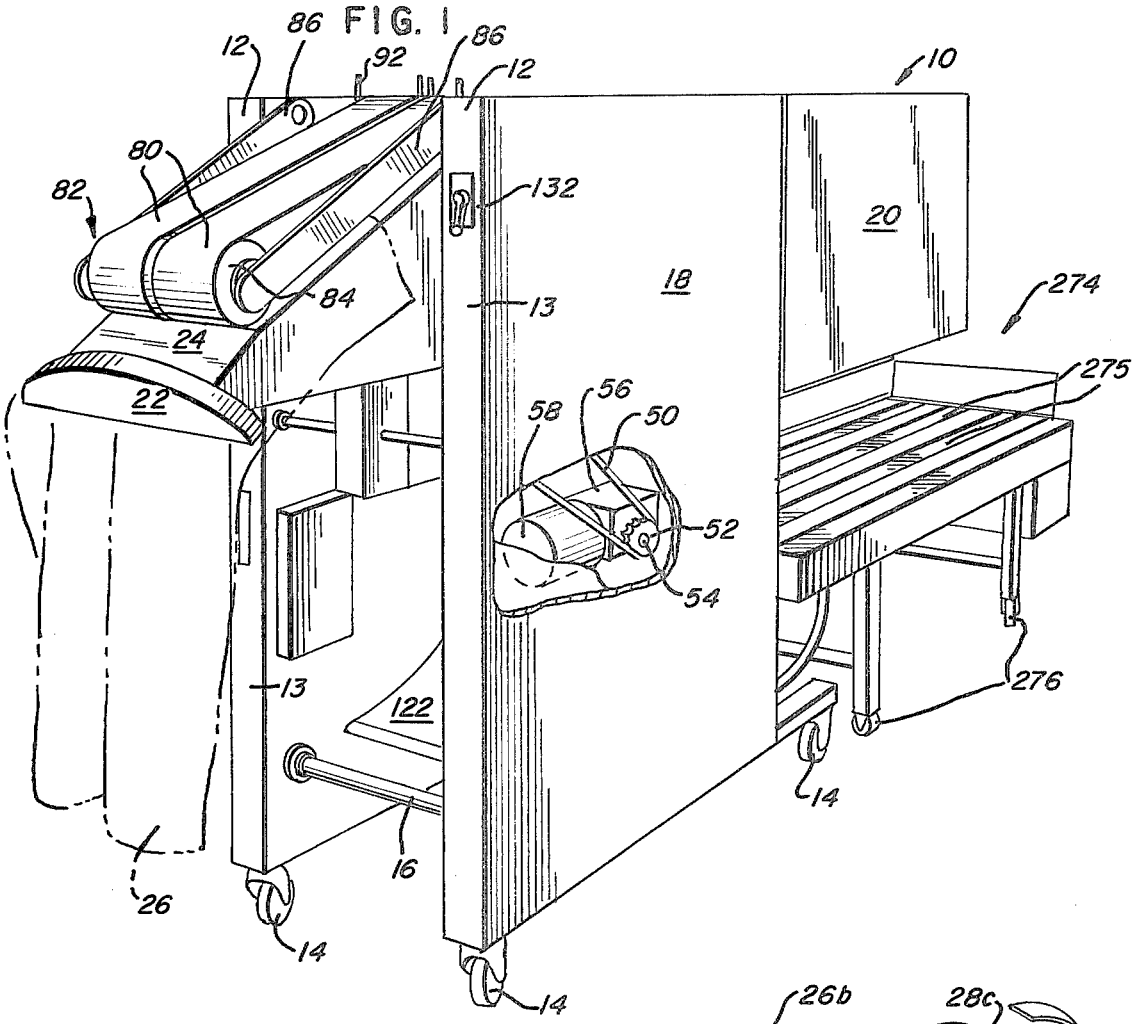
FIG. 1 is a perspective view partly broken away of one embodiment of a folding apparatus made in accordance with this invention.

Referring now more particularly to FIG. 1, a folding apparatus 10 is therein illustrated comprising opposed side frames 12. The opposed side frames are maintained in rigid spaced relationship by means of cross braces 16, one of which is illustrated in FIG. 1. Comprising external surfaces of the opposed side frames 12 are cover panels 18 and 20 which overlie driving belt members and rotating sprockets more clearly seen in FIG. 4 of the drawings. In the normal condition of apparatus use the covers 18 and 20 are in place as illustrated in FIG. 1, and for purposes of maintenance or repair the covers are removed or pivoted into a raised position so that the moving parts therebeneath illustrated in FIG. 4 may be accessible to a workman.

The apparatus of FIG. 1 is adapted to form a French fold in small or medium size foldable articles such as face towels, bath towels, napkins, pillow cases, diapers and hospital garments. In the course of forming a French fold, a foldable article is fed longitudinally into the apparatus 10 after the center of the piece has been centered on spreader 22 which is preferably formed of stainless steel or other smooth, durable material of fabrication. The spreader 22 is integrally formed with a stainless inclined feed table 24, and in FIG. 1 an article to be folded 26 is illustrated in phantom lines in draped engagement with the spreader 22 and attached feed table 24.

Figure 2:
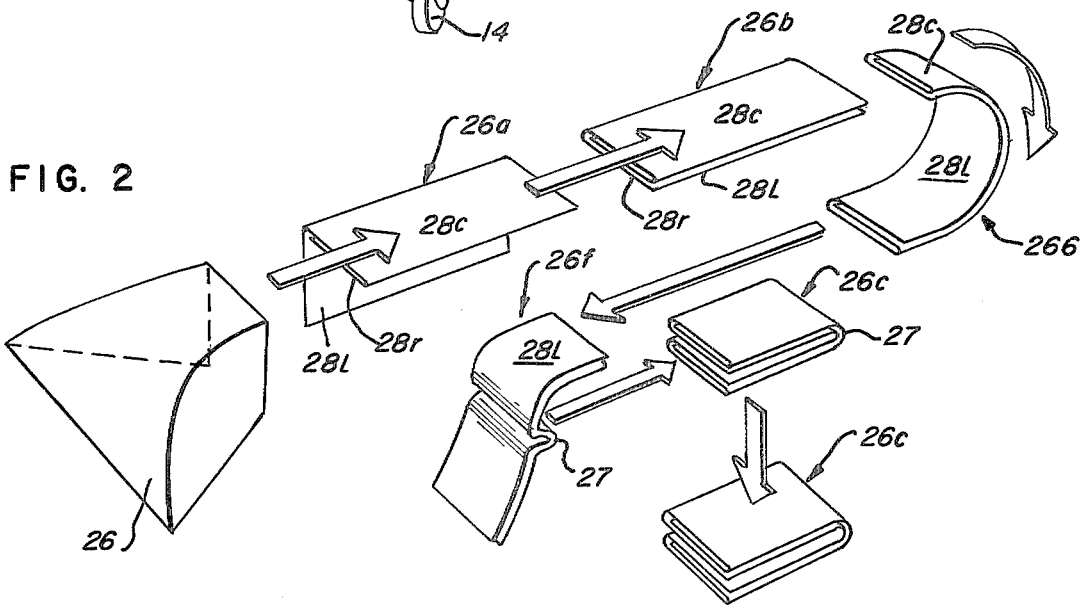
FIG. 2 is a schematic representation illustrating the various stages through which a foldable article passes in the course of being processed by the apparatus of FIG. 1.

Referring now more particularly to FIG. 2, the various stages which a foldable article 26 assumes in the course of being processed by the apparatus 10 are illustrated. The numeral 26 in FIG. 2 identifies a foldable article in the course of being disposed on the spreader and feed plate for feed-in purposes. The foldable article 26 assumes the condition of article **26*a* after such article has partially proceeded over the uppermost feed conveyor of the apparatus 10 wherein one of the article depending panels 28*r* is first folded by means of a folding plate beneath the central panel 28*c* whereafter as the foldable article 26*a* proceeds on the upper main feed conveyor the depending panel 28L is also folded beneath central panel 28*c*, so that the foldable article assumes the condition of article 26in which both the right and left side panels of the original foldable article 26 have been folded neatly beneath the central panel 28*c***. Such folding of an article into approximate thirds defines what is known as a French fold and is a fold most desirable for appearance purposes as when monogrammed towels, napkins or the like are displayed.

The French folded article **26*b* is driven from the end of the uppermost feed conveyor of the apparatus 10, in the direction of the arrow as indicated in FIG. 2 onto an underlying second conveyor whereon the French folded article 26*b*** changes direction and proceeds toward the front of feed end of the apparatus.

Upon being discharged from the second conveyor a cross-folding means engages the central portion of the French folded towel or the like **26*b* and central bight portion thereof 27 is driven between counter-rotating pinch rolls into the cross-folded form 26*c* in which the resultant article has not only had formed therein a French fold defined by two longitudinal folds and overlapping of the three panels 28*c*, 28*r* and 28L but in addition the article 20*c*** has been folded transversely in halves.

The folded article **26*c* is wedged between overlying continuous tapes of a third conveyor which slidably axially drives the folded article 26*c* over spaced runners of the third conveyor which comprises opposed portions of a trap door. Upon arriving at a predetermined location as the driven article 26*c* is driven over the spaced runners, a switch is actuated to stop the conveyor and open the trap door defined by the spaced runners, depositing the French folded and cross-folded sheet 26c** onto an underlying stacking conveyor.

Referring now to FIG. 7, spaced runners 30 are fragmentarily illustrated, each runner being integrally assembled with a pair of spaced triangular plate members 32, only one pair of such plate members 32 being illustrated in FIG. 7. Each pair of plate members and its integrally assembled runner threadably engages a positioning rod 34. The threads disposed to either side of central sprocket 36 mounted on the positioning rod 34 have threads of opposite direction so that when sprocket 36 is rotated, the opposed plates 32 and runners 30 are either driven apart or driven together.

In addition to engaging the threaded positioning rod 34, the spaced plates 32 also are supportedly engaged by transverse support rods 38 which slidably engage bushings 40 attached to inner plates 32, and serve to maintain the opposed double plates 32 in a rigid state of assembly.

Figure 4:
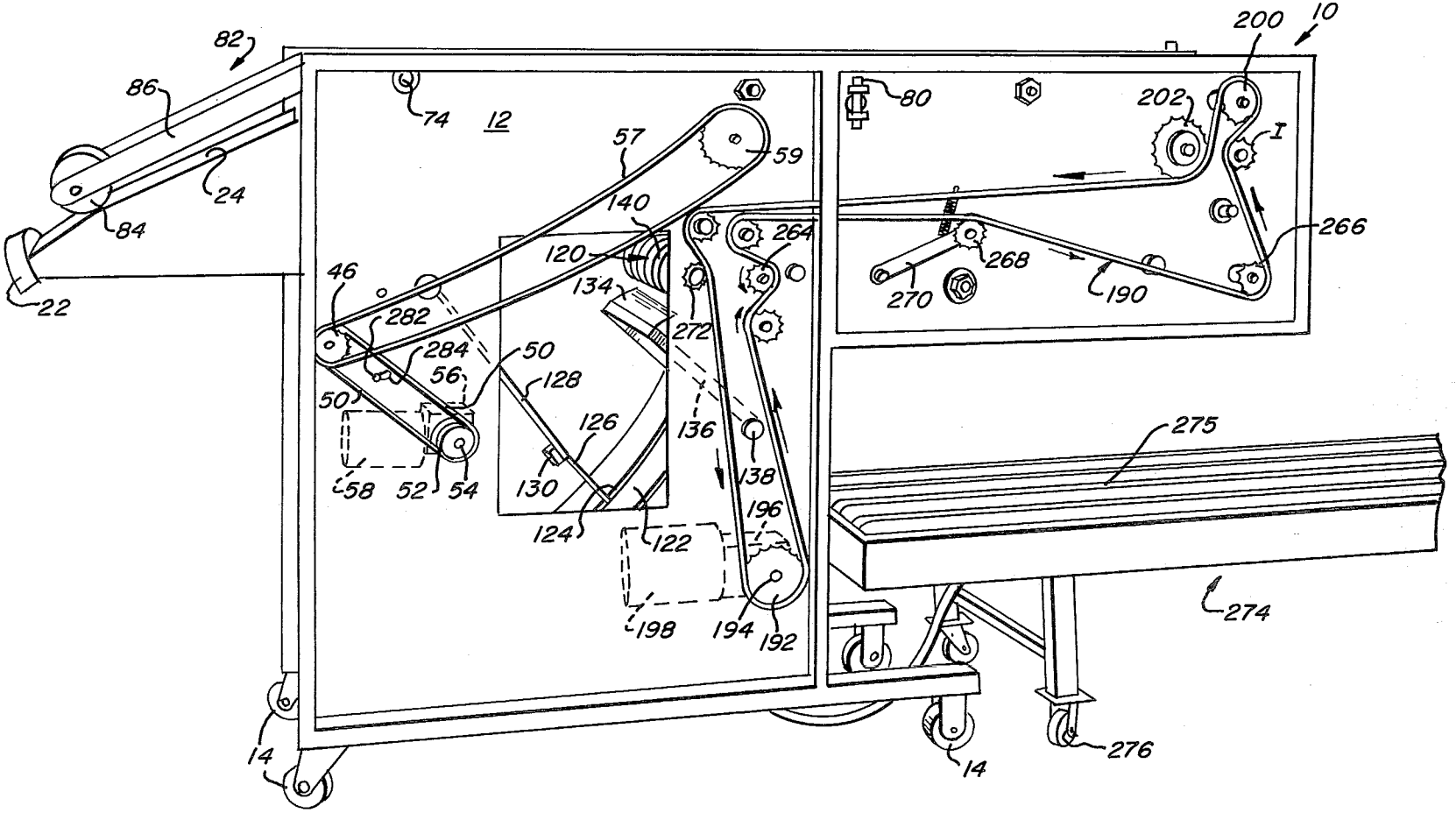
FIG. 4 is a perspective view illustrating one side of the apparatus of FIG. 1 with its cover panels removed so that the various drive elements employed in conjunction with the various conveyors in the cross-folding means of the provided apparatus may be more clearly seen.

Drive positioning sprocket 36 engages drive chain 42 which also engages lower sprocket 44 of FIG. 7 which is interconnected with sprocket-pulley 46 by means of rotatable shaft 48. The pulley portion of the pulley-sprocket 46 is engaged by a belt 50, see FIG. 4, said belt also engaging pulley 52 attached to the output shaft 54 of speed reducer 56 driven by positioning motor 58, said motor and speed reducer also being illustrated in the broken away portion of FIG. 1 of the drawing. The sprocket portion of the pulley-sprocket 46 drives chain 57 which in turn rotatably drives sprocket 59 as illustrated in FIG. 4.

Referring once again to FIG. 7, it will be noted that sprocket 59 rotatably drives threaded rod 60 which in turn threadably engages threaded opening 62 in brass bushing 63 rotatably mounted in pivot housing 64 illustrated in FIGS. 10 and 11. The upper flange portion 66 of housing 64 has openings 68 for reception of screws or other securing means which anchor the housing 64 to the undersurface of adjustable folding plate 70, illustrated in FIG. 7. Folding plate 70 is also pivotally mounted on fixed pivot 72 which is mounted on the right side frame 12. Actuation of positioning motor 58 thus simultaneously rotates positioning rod 34, setting the interval between runners 30 of the feed-in conveyor of the folding apparatus 10 while simultaneously positioning upper folding plate 70 by rotating sprocket 59 which in turn rotates rod 60 engaging threaded aperture 62 in rotatable brass bushing 63 of the pivot housing 64 secured to the undersurface of the plate 70.

A rear portion of the plate 70 is supported on a slidable bushing 74 mounted on a pivoting rod 76 connected to a shaft 78 rotatably mounted about a vertical post 81, see FIG. 7. Thus when the positioning motor 58 drives sprocket-pulley 46 the interval between the runners 30 of the feed conveyor and the angular disposition of the folded plate 70 about pivot point 72 are simultaneously set, the relative positions between the runners 30 and fold plate 70 being interrelated.

Figure 3:
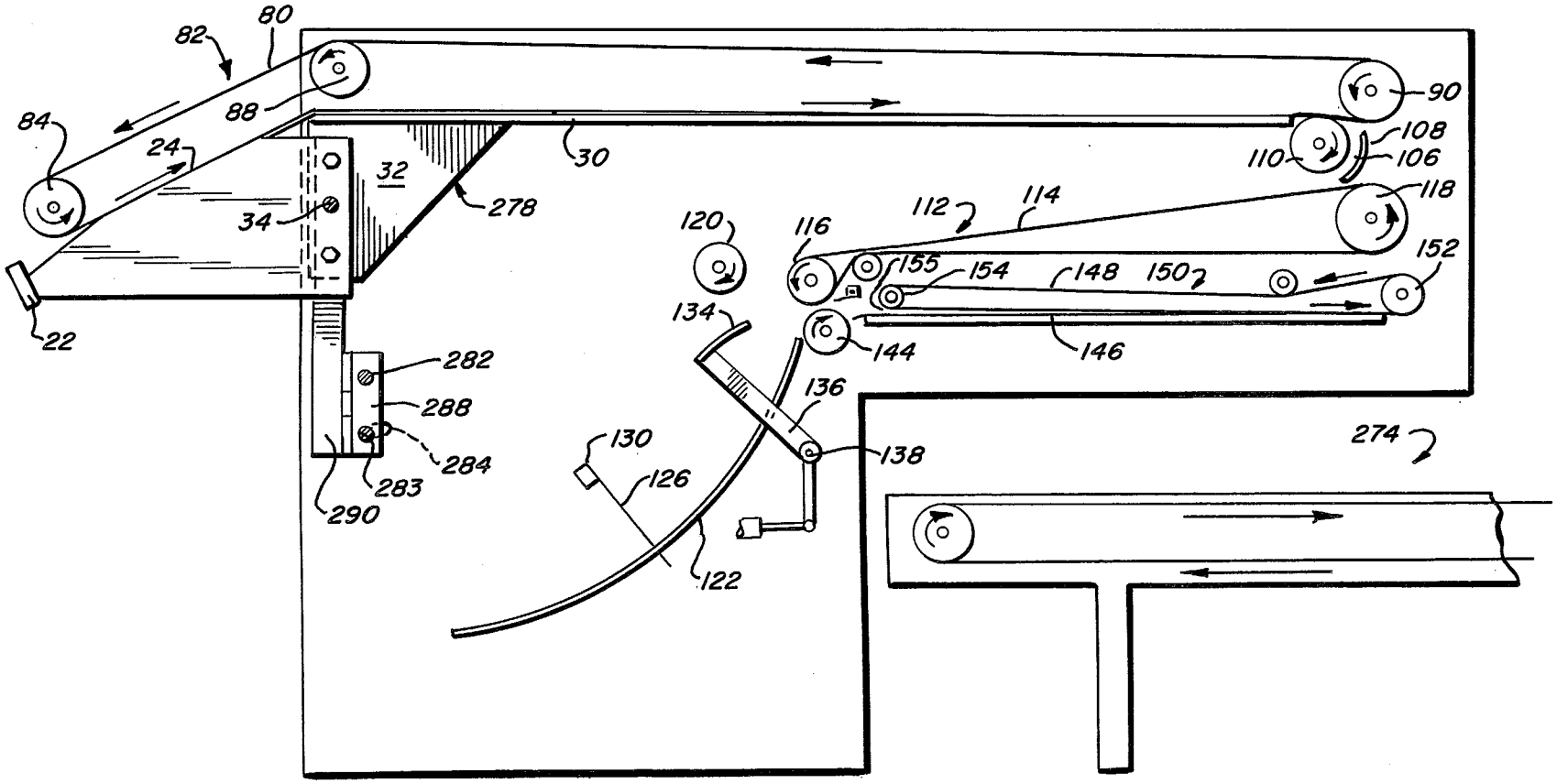
FIG. 3 is a somewhat schematic side elevational view illustrating the various conveyors employed in the apparatus of FIG. 1, together with apparatus elements forming the feed conveyors and employed in effecting a cross-fold.

The foldable article 26 which may comprise a towel or the like, after being draped over spreader 22 and feed plate 24 is pulled by constantly rotating belts 80 of uppermost feed conveyor 82, see FIG. 3, the latter belts being rotatably engaged with roller 84 mounted on arms 86 pivoted to the opposed side frames 12 of the folder 10. The continuous tapes 80 in addition to engaging the feedplate 24, move over roller 88 which initiates the horizontal run of the continuous tapes 80. The bottom run of the tapes 80 slidably move over the spaced runners 30 of the initial feed conveyor 82, and from the distal ends of the runners 30 the continuous tapes pass about rear roller 90 disposed on the same level as roller 88, and like roller 88 is journaled in opposed side wall portions 12 of the apparatus 10. The upper runs of the continuous belts 80 may be guided between the vertical pin guides 92 at the feed end of the machine to maintain a desired spaced relationship between the discrete belt members 80, (see FIG. 1).

Tapes 80 engage the upper surfaces of runners 30 in addition to rollers 84, 88 and 90. The tautness in such tapes may be regulated by the pins securing the tape ends together or by altering the angular disposition of the runners 30 which may be pivoted in the vertical plane as will hereinafter be explained in greater detail. The tautness in the tapes 80 comprises an element of control which determines the manner in which an article is slidably driven over the smooth-surfaced runners 30 by means of the lower runs of the continuous tapes 80. The lower runs of the tapes should be of sufficient tautness to grip the driven article over the runners while slidably engaging the runner portions not covered by the articles, with a minimum of friction. Also, the width of tapes 80 is such that sufficient surface area portions of a foldable article are engaged by the tape lower runs regardless of the interval between the runners 30.

Referring to FIG. 3, it will be noted that as the foldable article 26 is engaged by the lower run of the continuous tapes 80, the same is pulled beneath the rollers 84 and 88 onto the longitudinal spaced runners 30. The interval between the opposed outer longitudinal runner edges defines an effective article-supporting surface. Referring now to FIG. 7, it will be noted that upon proceeding over the supporting runners 30, a depending curved edge 96 of the upper, pivotally mounted fold plate 70 is engaged, said edge 96 proceeding inwardly beneath the left runner 30 as illustrated in FIG. 7 until straight edge portion 98 is reached.

Inner straight edge 98 of the pivotal fold plate 70 is adapted to lie in all positions of adjustment in substantial underlying alignment with the outer edge of the overlying runner 30 in the manner illustrated in sectional view of FIG. 8 although it will not be in perfect axial alignment for all positions of the pivotal plate 70. It is the purpose of the positioning motor 58 to effect a desired interval between the inner edges of the runners 30 while simultaneously effecting substantial alignment of edge 98 with the overlying outer edge 99 of the left runner 30 in the manner illustrated in FIG. 8. Said alignment being carried out regardless of the width of the article being folded.

Thus in accordance with the width of the articles being processed by the apparatus 10, the operator will effect a relative dispositon between the runners 30 of the feed conveyor 82 with a corresponding angular disposition of the right fold plate 70 so that the inner plate edge portion 98 will be in substantial alignment with the outer edge 99 of the left runner 30 as illustrated in FIGS. 7 and 8.

It is apparent from a comparison of FIGS. 8 and 9 that as the interval between the runners 30 varies with the width of the foldable articles being processed, the location of fold plate 70 must be accordingly altered so that the right flap portion **28*r* will be neatly disposed beneath the central panel portion 28*c* in the manner illustrated in FIGS. 2, 8 and 9**.

If not positioned far enough to the left in FIGS. 8 and 9, a distal article edge portion will drop from the edge of plate 70, causing "bunching" when panel 28L is folded in place. If plate 70 extends too far to the left in FIGS. 8 and 9, the lower panel 28L will not be desirably located beneath the article central panel.

Left fold plate 100, see FIGS. 7, 8 and 9, is fixedly positioned as it always serves to fold the left folded article panel 28L beneath the overlying panel **28*r* in the manner illustrated in FIGS. 8 and 9. As noted from FIG. 7, curved depending edge 96 of plate 100 stops short of fixed fold plate 100. When the left panel 28*r* of the foldable article 26*a* first engages depending lip 102 of the fixed plate 100 the right panel 28*r* will be folded in place as indicated in FIG. 2 of the drawing. The depending edges 96 and 102 never engage, even when plate 70 is at the end limit of its inward pivotal movement approaching fixed plate 100**.

Referring now to FIG. 3 it will be noted that upon reaching the ends of runners 30, the article **26*b* is downwardly driven by means of roller 90 of upper conveyor 82 into gap 106 defined by curved guide plate 108 and roller 110 rotating counter to overlying roll 90. A second conveyor 112 is composed of continuous belts 114 which rotatably engage ribbon roller 116 located adjacent the feed end of the conveyor and roller 118** is disposed at the rear end portion of the conveyor.

It will be seen from FIG. 3 that the upper conveying runs of the belts 114 convey folded articles from the rear of the apparatus 10 toward the feed end. Upon reaching terminal end of conveyor 112 defined by roller 116, the foldable article in the form of article **26*b* of FIG. 2 with the panel 28L uppermost, is driven downwardly from roll 116 by opposed counter-rotating guide roll 120. The terminal end of the article 26*b* drapes over the concave surface of plate 122 having a central slot 124 disposed therein, see FIG. 4 in which switch actuator arm 126 is adjustably positionable depending upon the length of the foldable item being processed by the apparatus 10. An adjustable arm 128 (see FIG. 4) adjustably positions the switch actuator 126 in slot 124 together with connected switch 130 by means of a length adjusting control disposed at edge planar surface 13 of left frame portion 12 as illustrated in FIG. 1, (the control being hidden by the overlying article spreader 22 and plate 24). A control 132 for actuating positioning motor 58 is illustrated in FIG. 1, disposed in edge planar surface 13 of the right frame portion 12 of apparatus 10**.

In accordance with the length of the foldable article being processed, the switch actuator 126 will be positioned in the plate slot 124 so as to energize means to actuate folding blade 134 disposed at the end of pivoting arm 136 mounted about pivot 138 as seen in FIGS. 3 and 4. It will be noted from FIG. 4 that roller 120 has protruding rubber strips 140 disposed about the roll periphery for purposes of better engaging the foldable article discharged from the end conveyor 112 and driving the same downwardly onto the curved surface of the underlying plate 122.

Following engagement with the folding blade 134, the foldable article **26*b* is folded in half in the manner illustrated in FIG. 2 and driven between counter-rotating pinch rolls 116 and 144 as seen in FIG. 3 whereby the foldable article assumes the form of 26*c* in FIG. 2 and is driven onto spaced runners 146, see FIGS. 5 and 6 over which slidably move continuous belts 148 of the discharge conveyor 150, see FIG. 3. The belts 148 engage roller 152 at the rear end of the folder apparatus and roller 154 disposed adjacent the feed end of the apparatus 10**.

It will be noted from FIG. 3 that there is a slight gap 155 at the entrance end or feed end of lowermost conveyor 50, resulting from the spaced relationship of the roller 154 from the underlying spaced runners 146. The gap enables the double bight leading edge 27 (see FIG. 2) of a foldable article in the form of article **26*c* to be engaged by the overlying continuous belts 148 and slidably, axially driven over the spaced runners 146 which receive the folded article 26*c* in the planar support position of FIG. 6**.

In FIG. 5 the opposed runners 146 are seen to be securely affixed to connecting strip portions 160 which interconnect each runner to an actuating rod 162. Each rod 162 has a short offset portion 164 rotatably mounted in a fixed positioning collar 166 from which extends at right angles a rod portion 168 pivotally connected at 170 to a rotatable square plate 172 mounted by means of a centering bolt or pivot pin 174 to a rear frame portion 176 of apparatus 10. Plate 172 comprises actuating means for rotating the opposed rod portions 164 rotatably mounted in the fixed collars 186 with the assistance of pivotally mounted, pneumatic piston and cylinder unit 178 of FIG. 5.

When piston rod 180 of unit 178 is retracted in the position illustrated in FIG. 5, the rod 180 which is also pivotally connected at 170 to plate 172 forces the right rod 168 to rotate counter clockwise in the direction of the illustrated arrows so that the runner 146 is rotated downwardly into a substantially vertical position. Simultaneously the left rod 162, FIG. 5, forced to rotate clockwise by means of its pivotal connection at 184 to plate 172 forcing the attached left runner to rotate into substantially the vertical plane as is also illustrated in FIG. 5.

When rod 180 of the pneumatic piston and cylinder unit 178 is extended into the position illustrated in FIG. 6, pivot plate 172 is forced to rotate clockwise simultaneously rotating the attached arms 162 and the attached runners 146 into the horizontal plane as illustrated in FIG. 6, in which position the runners are adapted to receive the foldable article in the condition of **26*c* of FIG. 2**.

The means for actuating the piston and cylinder unit 178 into the discharge position of FIG. 5 comprises a switch actuator 184 illustrated in FIG. 6 and located in the path of movement of foldable article **26*c* adapted to be moved over the runners 146 by the lower runs of the continuous tapes 148 of the lowermost conveyor 150, see FIG. 3. Fixed mounting rods not illustrated, may engage spaced collar portions 186 of the runners 146 for purposes of providing a rigid supporting structure for the spaced runners 146**.

FIG. 4 illustrates the various driving belts and chains employed with the apparatus 10 and depicts the right frame portion 12 of the apparatus with the overlying cover plates 18 and 20 (see FIG. 1) removed. It will be seen that a single continuous drive chain 190 engages drive sprocket 192 mounted on output shaft 194 of speed reducer 196 driven by main drive motor 198. The main drive chain 190 engages the sprocket 200 which drives roller 90 of the uppermost feed conveyor 82 as well as sprocket 202 connected to the shaft on which roller 110, see FIG. 3, is mounted for purposes of driving the foldable article in the form of **26*b* in FIG. 2 into the gap 106 onto the second conveyor 112**.

Chain 190 also engages sprocket 264 which is mounted on the same shaft as roller 116 of the second conveyor 112. Drive sprocket 266 engaged by chain 190 is mounted on the same roll with continuous tapes 148 of the third lowermost conveyor 150 which drives the foldable articles over the trap-door runners 146. Sprocket 268 is mounted on a spring loaded pivotal arm 270 for maintaining desired tension in the drive chain 190, which also engages a number of idler rollers for effecting desired direction of rotation in the above-noted drive rollers. It will be seen from FIG. 4 that the drive chain also engages sprocket 272 which rotatably drives the deflecting roll 120 of FIG. 4.

Actuation of switch arm 184 in FIG. 6 not only results in actuation in the piston and cylinder unit 178 but in addition actuates a pivotally mounted brake shoe 179 (see FIG. 13) by means of pneumatic piston and cylinder unit 181 which momentarily stops drive roller 152 of the lowermost conveyor 150. Unit 181 is mounted in the left side frame 12 of apparatus 10. After a short time delay, the opposed runners 146 are rotated into the discharge position of FIG. 5 and return to the support position of FIG. 6, thereby causing the foldable article disposed on the runners 146 to be discharged in the vertical plane while in a stationary condition on such runners.

The formation of a neat underlying stack on stacking conveyor 274 illustrated in FIGS. 1 and 4, and schematically and partially shown in FIG. 3 is assured. The continuous ribbons 275 of conveyor 274 are driven by an independent motive means not illustrated, the latter motive means being energized by a counter and relay sensitive to the number of actuations of the trap door from which the foldable articles of the apparatus 10 are discharged in a manner known in the art as disclosed in Kamberg patent 2,361,424.

Accordingly, after a stack of a predetermined number of foldable articles is formed on the conveyor 274 the continuous tapes 275 may be moved so as to form a series of spaced stacks which may be gathered at the convenience of an attendant. It will be noted from FIGS. 1 and 4 that the stacking conveyor 274 is mounted on casters 276 enabling such conveyor to be positioned as desired for the convenience of the attendant.

In resume, therefore, it is seen that the foldable article 26 is formed by the upper conveyor 82 of the apparatus 10 comprising the spaced runners 30 and underlying fold plates 70 and 100 into the French folded article **26*b*. Article 26*b* is discharged onto the second conveyor 112 schematically illustrated in FIG. 3 and moved toward the front of the conveyor. The leading article edge is forced down between opposed driving rolls 120 and 116 until it engages the switch actuator 126. Switch arm 126 serves to actuate folding blade 134, with the assistance of a penumatic actuating cylinder, forming a cross-fold which drives the article between the counter-rotating pinch rolls 116 and 144 of FIG. 3 onto a third conveyor 150 comprising supporting spaced runners 146 and tapes 148. Runners 146 in conjunction with the overlying continuous tapes 148 axially drive the foldable article 26*c* until switch actuator 184 of FIG. 6 is engaged whereby the final folded article drops in the vertical plane as indicated in FIG. 2 onto the underlying stacking conveyor 274 illustrated in FIGS. 1, 3 and 4**.

A unique structural feature of the provided apparatus comprises an assembly in which the spaced runners 30, attached rod and driving sprocket mechanisms integrally form a unit 278 (see FIGS. 3 and 12). Unit 278 is pivotally mounted in the opposed side frames 12. The angular disposition of the cantileverd runners 30 may thus be readily set by pivotal adjustment of the entire unitary assembly 278, see FIG. 3, as the same moves on a pivot rod 282, journaled in bearings disposed in opposed side frames 12. A second supporting transverse rod 283 in mounted in arcuate slots 284 disposed in opposed side frames 12 and one of which is illustrated in phantom lines in FIG. 3. The rods 282 and 283 traverse support bracket 288 for assembly 278 which is in turn secured to vertical support members 290. The assembly 278 may be locked in place after a desired angular disposition of the runners 30 is assumed, by means of locking nuts or the like engaging the distal ends of lower rod 283 illustrated in FIG. 3.

It is believed apparent from the foregoing that various modifications may be made in the apparatus above disclosed in detail, which modifications will still remain within the ambit of this invention disclosed.

Applicant's apparatus is composed of a minimum number of structurally simple components well known in the art and of relatively simple design which may be manufactured at low cost, readily assembled and inexpensively maintained. The provided apparatus is extremely durable, while providing for flexibility of use so as to accommodate a plurality of items varying in length and width fed rapidly into the feed conveyor. It is apparent that in the normal course of use the attendant would first sort out the various foldable items into different size categories, whereafter each size would be processed, and an appropriate width and length setting made when it is contemplated that a different sized article be processed.

The novel adjusting means of applicant enables both the supporting runners of the feed conveyor and the disposition of the adjacent underlying folding plate to be simultaneously set by a fingertip control. Similarly, switch disposition for effecting a cross-fold is readily set by positioning a lever for the article being folded. This invention is to be limited, therefore, only by the scope of the appended claims.

What is claimed is:

1. A folding apparatus comprising spaced parallel article support surfaces; having outermost parallel edges; the interval between said outermost edges of said support surfaces, defining an intervening effective article support surface; spaced support means for said opposed article support surfaces; a folding plate disposed beneath said support surfaces having parallel longitudinal edges; a first pivot mounted adjacent one end portion of said plate adjacent one longitudinal plate edge supportably mounting said plate for pivotal movement in a plane substantially parallel to said support surfaces; said folding plate parallel longitudinal edges being interconnected by a transverse article-engaging edge substantially traversing the interval between said outermost edges of said parallel support surfaces; motive means connected to said support means for said article support surfaces for uniformly moving said article support surfaces toward and away from each other in parallel relation; said motive means also being connected to said folding plate and simultaneously pivotally moving said folding plate about said pivot so that one of said folding plate longitudinal edges opposed to said pivot is maintained in substantial underlying alignment with the outermost edge of an overlying article support surface.

2. The folding apparatus of claim 1 in which said motive means includes a threaded rod having uniformly threaded end portions of opposite thread direction uniformly spaced from the longitudinal center of said rod and engaging opposed threaded openings in said spaced support means whereby rotation of said rod in one direction of rotation uniformly moves said support means and support surfaces away from said rod center and rotation of said rod in a direction opposite to said one direction of rotation uniformly moves said support means and support surfaces toward said rod center.

3. The folding apparatus of claim 2 in which said folding plate is supported on a second pivotal support spaced from said first pivot; said second support comprising a housing fixed to the undersurface of said folding plate and a rotatable bushing mounted therein having a threaded opening; a rotatable threaded shaft mounted at substantially right angles to the longitudinal edges of said folding plate threadedly engaging said rotatable bushing threaded opening whereby rotation of said shaft pivotally moves said folding plate about said first pivot.

4. The folding apparatus of claim 3 in which said motive means includes a means for simultaneously rotatably driving said threaded rod and said threaded shaft whereby said folding plate pivots outwardly away from said first pivot when said article support surfaces are driven apart and pivots said folding plate inwardly toward said first pivot when said article support surfaces are driven together.

5. The folding apparatus of claim 1 in combination with a second folding plate disposed beneath the pivotally mounted folding plate and having longitudinal edge portions parallel to said support surfaces and a transverse article engaging edge portion interconnecting said longitudinal edge portions.

6. A folding apparatus comprising spaced parallel article support surfaces; the outermost edges of said support surfaces defining an intervening effective article support surface; spaced support means for said opposed article support surfaces having aligned threaded openings; a folding plate having parallel longitudinal edge portions disposed beneath said support surfaces; a first pivot mounting one end portion of said folding plate adjacent one plate longitudinal edge for pivotal movement in a plane substantially parallel to said support surfaces; said plate parallel longitudinal edges being interconnected by a transverse edge traversing the interval between said outermost edges of said parallel support surfaces; threaded rod means having opposed threaded ends with threads of opposite direction uniformly located relative to the longitudinal center of said rod means and threadably engaging the threaded openings of said support means for said article support surfaces; said rod means being adapted to uniformly move said article support surfaces toward and away from each other in parallel relation; rotation of said rod means in one direction of rotation driving said support surfaces apart uniformly relative to said rod means longitudinally center, and rotation of said rod means in a direction opposite to said one direction uniformly driving said support surfaces together; motive means for rotatably driving said threaded rod means; said motive means also being connected to said folding plate and simultaneously pivotally moving said folding plate so that the longitudinal edge thereof opposed to said pivot is maintained in substantial underlying alignment with the outermost edge of the overlying article support surface.

* * * * *

UNITED STATES PATENT AND TRADEMARK OFFICE

CERTIFICATE OF CORRECTION

PATENT NO. : 4,093,205

DATED : June 6, 1978

INVENTOR(S) : Kasimir Kober

It is certified that error appears in the above-identified patent and that said Letters Patent are hereby corrected as shown below:

Column 2, line 20, change "conveyr" to -- conveyor --.

Column 4, line 39, delete "26in" and insert -- 26b in --.

Column 9, line 68, change "cantileverd" to -- cantilevered --.

Column 10, line 5, change "in" (1st occurrence) to -- is --.

Column 12, claim 6, line 24, change "gitudinally" to -- gitudinal --

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*